US009065233B2

(12) United States Patent
Yabe

(10) Patent No.: US 9,065,233 B2
(45) Date of Patent: Jun. 23, 2015

(54) TERMINAL CONNECTION STRUCTURE AND METHOD OF MANUFACTURING THE SAME

(75) Inventor: Kazuyoshi Yabe, Susono (JP)

(73) Assignee: Yazaki Corporation, Tokyo (JP)

( * ) Notice: Subject to any disclaimer, the term of this patent is extended or adjusted under 35 U.S.C. 154(b) by 293 days.

(21) Appl. No.: 13/811,157

(22) PCT Filed: Jul. 6, 2011

(86) PCT No.: PCT/JP2011/065466

§ 371 (c)(1),
(2), (4) Date: Jan. 18, 2013

(87) PCT Pub. No.: WO2012/011388

PCT Pub. Date: Jan. 26, 2012

(65) Prior Publication Data

US 2013/0112476 A1 May 9, 2013

(30) Foreign Application Priority Data

Jul. 22, 2010 (JP) ..... 2010-164761

(51) Int. Cl.
*H01R 43/02* (2006.01)
*H01R 4/18* (2006.01)

(52) U.S. Cl.
CPC ..... *H01R 43/02* (2013.01); *Y10T 29/49179* (2015.01); *H01R 4/187* (2013.01); *H01R 43/0207* (2013.01); *H01R 4/18* (2013.01)

(58) Field of Classification Search
CPC ..... H01R 43/02; H01R 4/18
USPC ..... 174/84 C; 29/860
See application file for complete search history.

(56) References Cited

U.S. PATENT DOCUMENTS

| | | | | |
|---|---|---|---|---|
| 6,538,203 | B1 * | 3/2003 | Nolle et al. | 174/84 R |
| 2009/0315419 | A1 | 12/2009 | Mita et al. | |
| 2011/0058307 | A1 * | 3/2011 | Lee et al. | 361/502 |

FOREIGN PATENT DOCUMENTS

| | | | |
|---|---|---|---|
| JP | 6-302341 | A | 10/1994 |
| JP | 2009-187683 | A | 8/2009 |
| JP | 2010-3439 | A | 1/2010 |

OTHER PUBLICATIONS

Communication dated Jun. 17, 2014 from the Japanese Patent Office in counterpart Japanese application No. 2010164761.

* cited by examiner

*Primary Examiner* — Timothy Thompson
*Assistant Examiner* — Charles Pizzuto
(74) *Attorney, Agent, or Firm* — Sughrue Mion, PLLC

(57) ABSTRACT

A wire crimping section (11) of a terminal (10) comprises a base section (13) upon which a conductor (1) of a wire (W) is arranged; and a pair of caulking sections (14) that is formed in extension from the base section (13), and that is caulked so as to crimp the conductor (1). A friction-agitation connection section (20), which is formed by making the conductor (1), the base section (13), and the pair of caulking sections (14) into a state of integrated plastic flow, is provided on the wire crimping section (11).

6 Claims, 7 Drawing Sheets

TERMINAL CONNECTION STRUCTURE AND METHOD OF MANUFACTURING THE SAME

TECHNICAL FIELD

The present invention relates to a terminal connection structure for connecting a terminal to a wire and a method of manufacturing the terminal connection structure.

BACKGROUND ART

A terminal connection structure of a conventional example is shown in FIGS. 1 and 2. In FIGS. 1 and 2, a wire W includes a conductor 50 and an insulating coating 51 that covers an outer periphery of the conductor 50. At an end of the wire W, the insulating coating 51 is peeled to expose the conductor 50. A terminal 60 is connected to the exposed conductor 50.

The terminal 60 includes a wire crimping section 61 and an external connection section 62. The wire crimping section 61 includes a base section 61*a* and a pair of caulking sections 61*b* formed in extension from opposite edges of the base section 61*a*. By caulking the pair of caulking sections 61*b*, the conductor 50 is fixed to the wire crimping section 61 by a crimping force thereof.

A terminal connection structure of another conventional example (see Patent Literature 1) is shown in FIGS. 3 and 4. In FIGS. 3 and 4(*a*), a terminal 70 includes a wire crimping section 71 and an external connection section 72. The wire crimping section 71 includes a base section 71*a* and a pair of caulking sections 71*b* formed in extension from opposite edges of the base section 71*a*. By caulking the pair of caulking sections 71*b*, a conductor 50 is fixed to the wire crimping section 71 by a crimping force thereof.

Furthermore, the conductor 50 and the pair of caulking sections 71*b* have a friction-agitation connection section 73 formed by making these sections into a state of integrated plastic flow. The friction-agitation connection section 73 is formed by using a connection tool (not shown) having a pin at the tip of a shoulder and operating the connection tool from the side of the pair of caulking sections 71*b*.

CITATION LIST

Patent Literature

Patent Literature 1: Japanese Patent Application Laid-open No. 2009-187683

DISCLOSURE OF INVENTION

Problem to be Solved by the Invention

However, in the terminal connection structure of the former conventional example, the conductor 50 and the wire crimping section 61 are fixed only by the crimping force. As the crimping force increases, electric contact resistance between the conductor 50 and the wire crimping section 61 is stabilized at lower values. However, when the crimping force increases, fixing strength (tensile strength) between the conductor 50 and the wire crimping section 61 decreases. It is because when the crimping force is large, the conductor 50 extends in an axial direction to decrease a sectional area thereof. Therefore, a decrease in the electric contact resistance and an increase in the fixing strength (tensile strength) cannot be ensured concurrently.

On the other hand, in the terminal connection structure of the latter conventional example, the conductor 50 and the wire crimping section 71 are fixed not only by the crimping force but also by a connection force of the friction-agitation connection section 73. Accordingly, the fixing strength (tensile strength) can be increased without increasing the crimping force of the wire crimping section 61. Therefore, while causing the electric contact resistance to be lower than in the terminal connection structure of the former conventional example, the fixing strength (tensile strength) can be increased. However, as shown in FIG. 4(*b*), a gap 80 is likely to be formed between the conductor 50 and the base section 71*a* because of terminal deformation due to an external force or slight terminal deformation due to a temperature change of an external environment or energization heat generation. If the gap 80 is generated between conductor 50 and the base section 71*a*, it leads to an increase in the electric contact resistance or a decrease in the fixing strength (tensile strength). Accordingly, also in the latter conventional example, a decrease in the electric contact resistance and an increase in the fixing strength (tensile strength) cannot be ensured sufficiently and reliably.

As shown in FIG. 5, the conductor 50 is crimped in a state where there is an empty space 81 on opposite sides in the wire crimping section 71. Therefore, element wires 50*a* of the conductor 50 are likely to become loose due to an external force or the like, which is also a factor of an increase in the electric contact resistance or a decrease in the fixing strength.

The present invention has been achieved to solve the above problems, and an object of the present invention is to provide a fixed terminal connection structure that can sufficiently and reliably ensure a decrease in the electric contact resistance and an increase in the fixing strength concurrently, and a method of manufacturing the terminal connection structure.

Means for Solving Problem

To achieve the above object, a first aspect of the present invention is to provide a terminal connection structure for connecting a terminal to a wire, comprising: a wire crimping section of the terminal, the wire crimping section having a base section upon which a conductor of the wire is arranged, and a caulking section formed in extension from the base section and caulked so as to crimp the conductor; and a friction-agitation connection section formed by making both of the base section and the caulking section together with the conductor into a state of integrated plastic flow.

In a second aspect of the present invention depending on the first aspect, in the terminal connection structure, the terminal has an external connection section as a separate body from the wire crimping section; and the friction-agitation connection section is formed by making also the external connection section together with the base section, the caulking section, and the conductor into the state of integrated plastic flow.

To achieve the above object, a third aspect of the present invention is to provide a method of manufacturing a terminal connection structure, comprising: a wire crimping step of mounting a conductor on an upper surface of a base section of a wire crimping section of a terminal, and caulking a caulking section formed in extension from the base section to cover the conductor, thereby crimping the conductor; and a friction-agitation connection-processing step of, after the wire crimping step, performing friction-agitation connection processing to the wire crimping section by using a connection tool, and making both of the base section and the caulking section together with the conductor into a state of integrated plastic flow, thereby forming a friction-agitation connection section.

In a fourth aspect of the present invention depending on the third aspect, in the method of manufacturing a terminal connection structure, the connection tool is operated from a side of the base section in the friction-agitation connection-processing step.

In a fifth aspect of the present invention depending on the third or fourth aspect, in the method of manufacturing a terminal connection structure, the terminal includes an external connection section as a separate body from the wire crimping section; and in the friction-agitation connection-processing step, the external connection section is closely attached to an external surface of the wire crimping section, the connection tool is operated from a side of the external connection section, and the external connection section is also made into the state of integrated plastic flow, thereby forming the friction-agitation connection section.

Effect of the Invention

According to the present invention described in the first to fifth aspects, the conductor and the wire crimping section are fixed by the crimping force and the connection force of the friction-agitation connection section. Because the conductor is fixed to the caulking section and to the base section by the friction-agitation connection section, the conductor is rigidly fixed between the caulking section and the base section. Accordingly, no gap is formed between the conductor and the caulking section and between the conductor and the base section because of terminal deformation due to an external force or slight terminal deformation due to a temperature change of the external environment or energization heat generation. With this configuration, a decrease in the electric contact resistance and an increase in the fixing strength can be ensured sufficiently and reliably.

EMBODIMENT FOR CARRYING OUT THE INVENTION

Embodiments of the present invention are explained below with reference to the drawings.

First Embodiment

Figure 1:
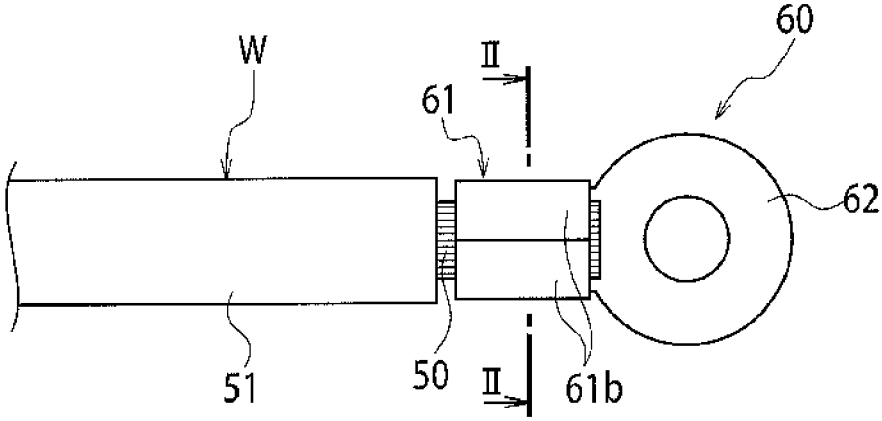
FIG.1 PRIOR ART
FIG. 1 is a top view of a terminal connection structure of a conventional example.
Figure 2:
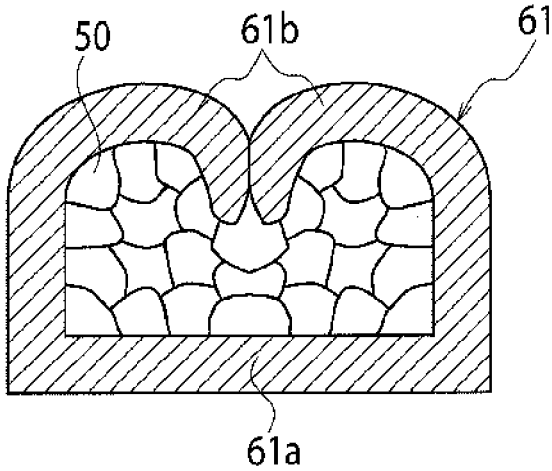
FIG.2 PRIOR ART
FIG. 2 is an enlarged cross-sectional view along a line II-II in FIG. 1.
Figure 3:
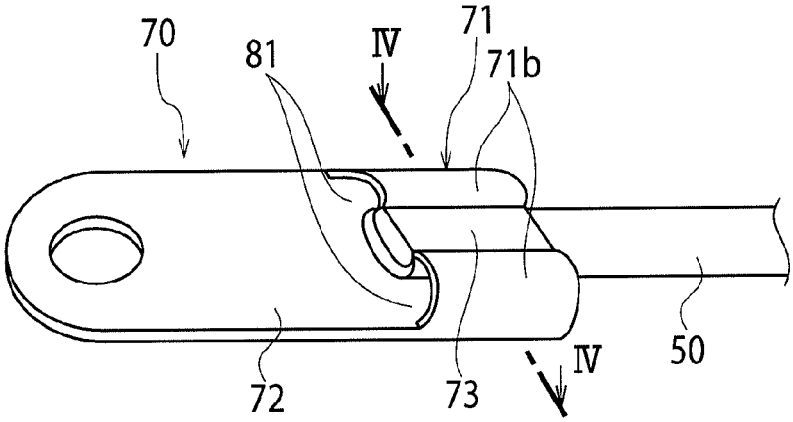
PRIOR ART FIG.3
FIG. 3 is a perspective view of a terminal connection structure of another conventional example.
Figure 4:
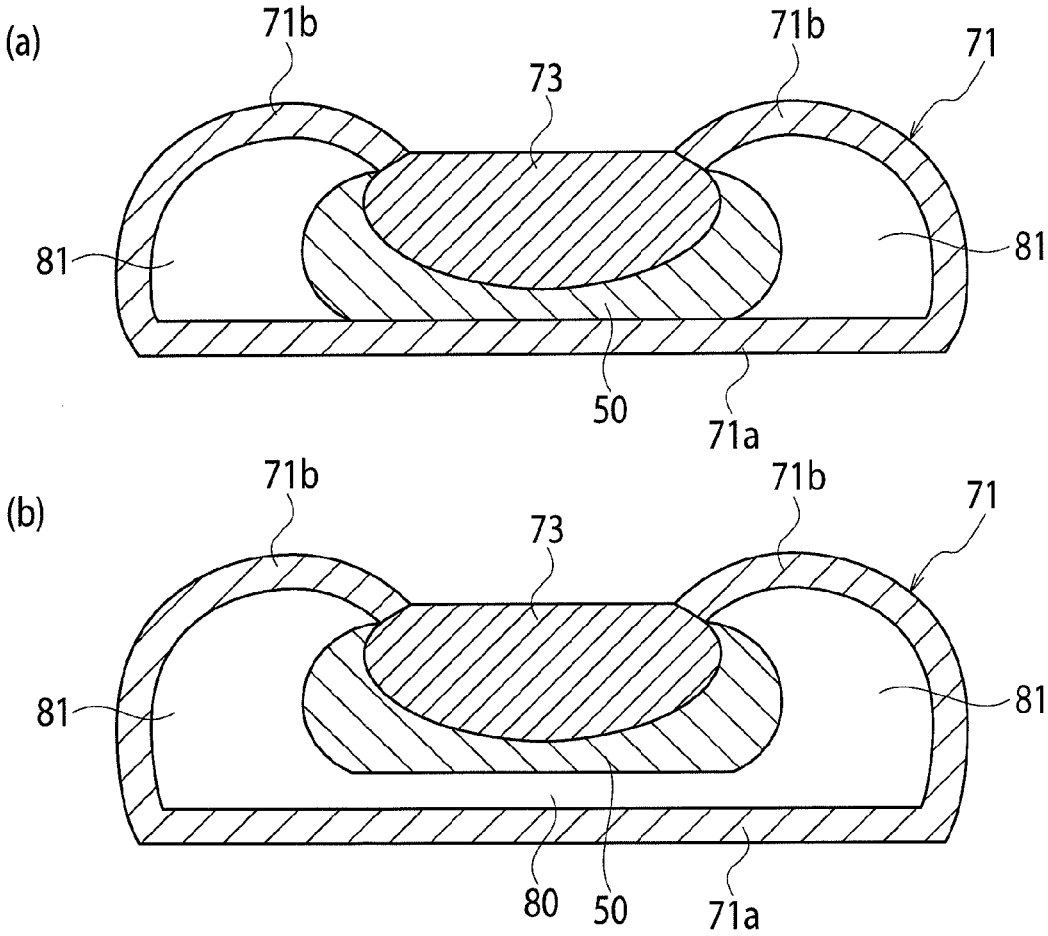
FIG.4 PRIOR ART
FIG. 4(*a*) is an enlarged cross-sectional view along a line IV-IV in FIG. 3, and FIG. 4(*b*) is an enlarged cross-sectional view along the line IV-IV in FIG. 3 and shows a state where a gap is formed between a conductor and a base section.
Figure 5:
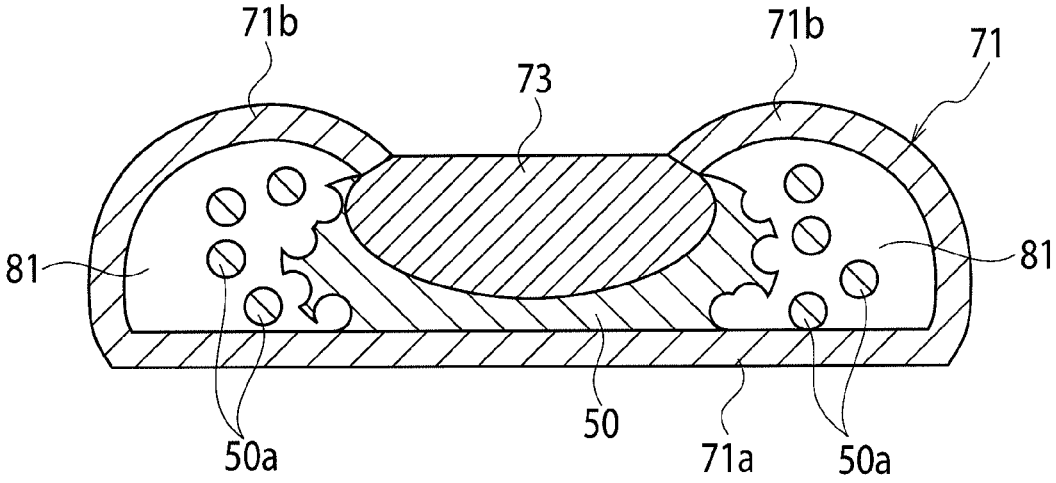
FIG.5 PRIOR ART
FIG. 5 is an enlarged cross-sectional view along the line IV-IV in FIG. 3 and is a view showing a state where element wires of a conductor become loose.
Figure 6:
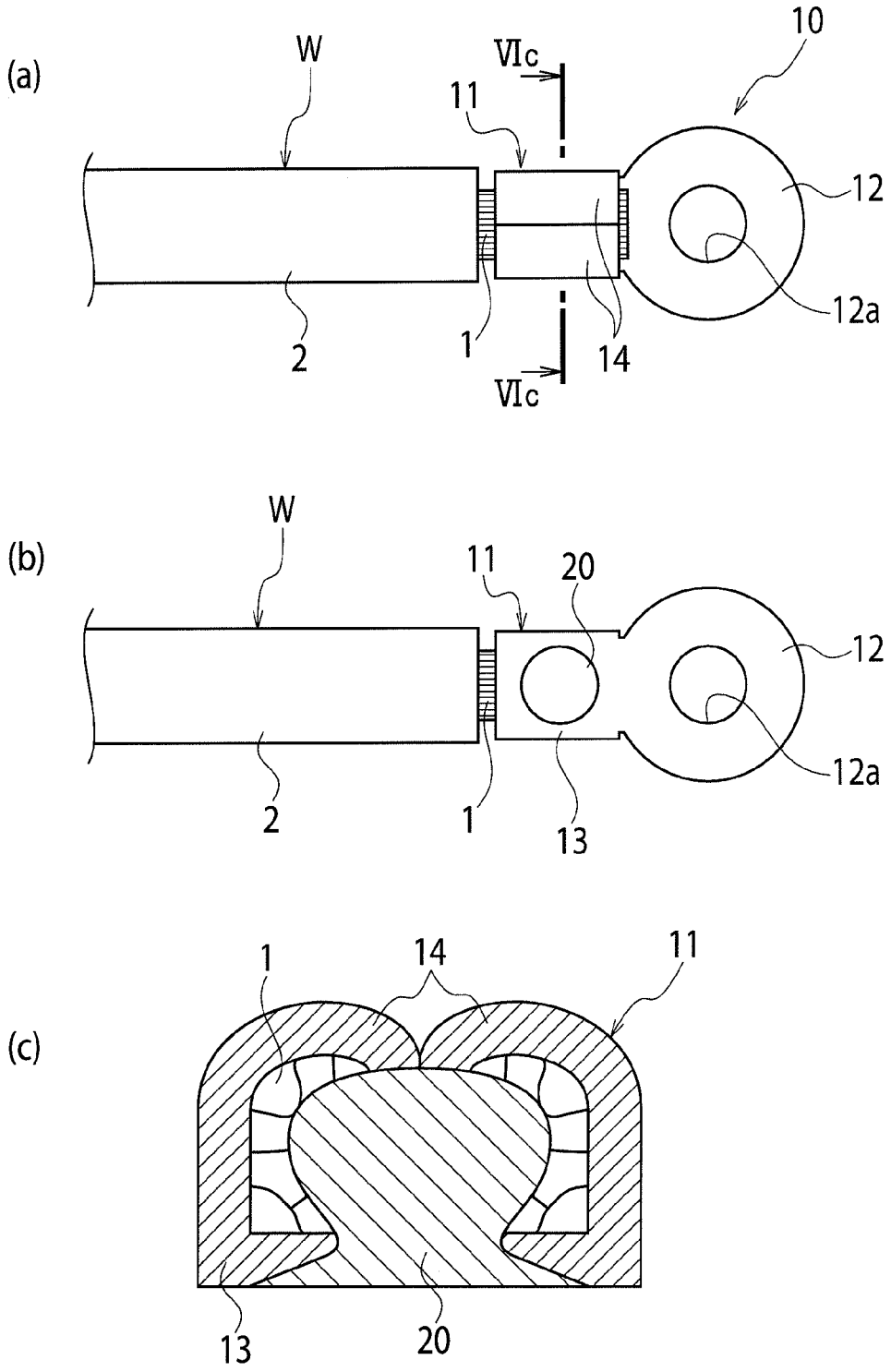
FIGS. 6(*a*), 6(*b*) and 6(*c*) show a first embodiment of the present invention, FIG. 6(*a*) being a top view of a terminal connection structure, FIG. 6(*b*) being a rear view of the terminal connection structure, and FIG. 6(*c*) being an enlarged cross-sectional view along a line VIc-VIc in FIG. 6(*a*).

FIGS. 6(*a*) to 6(*c*) show a terminal connection structure according to a first embodiment of the present invention. In FIGS. 6(*a*) to 6(*c*), a wire W includes a conductor 1 and an insulating coating 2 that covers an outer periphery of the conductor 1. The conductor 1 is formed by twisting a plurality of element wires (not shown). The insulating coating 2 is made of an insulating synthetic resin material. At an end of the wire W, the insulating coating 2 is peeled to expose the conductor 1. A terminal 10 is connected to the exposed conductor 1.

The terminal 10 is formed by bending one sheet metal having a predetermined shape. The terminal 10 includes a wire crimping section 11, and an external connection section 12 integrally formed with the wire crimping section 11. The wire crimping section 11 includes a base section 13 and a pair of caulking sections 14 formed in extension from opposite edges of the base section 13. The conductor 1 is mounted on an upper surface of the base section 13, and the pair of caulking sections 14 is caulked so as to crimp the conductor 1 from above.

A friction-agitation connection section 20 is provided to the conductor 1, the pair of caulking sections 14, and the base section 13, which is formed by making these sections into a state of integrated plastic flow.

The external connection section 12 has a circular shape and has a mounting hole 12*a* at the center thereof. Another wire or the like is connected by using the mounting hole 12*a*.

A manufacturing procedure of the terminal connection structure described above is explained next.

First, the insulating coating 2 at the end of the wire W is peeled to expose the conductor 1.

Figure 7:
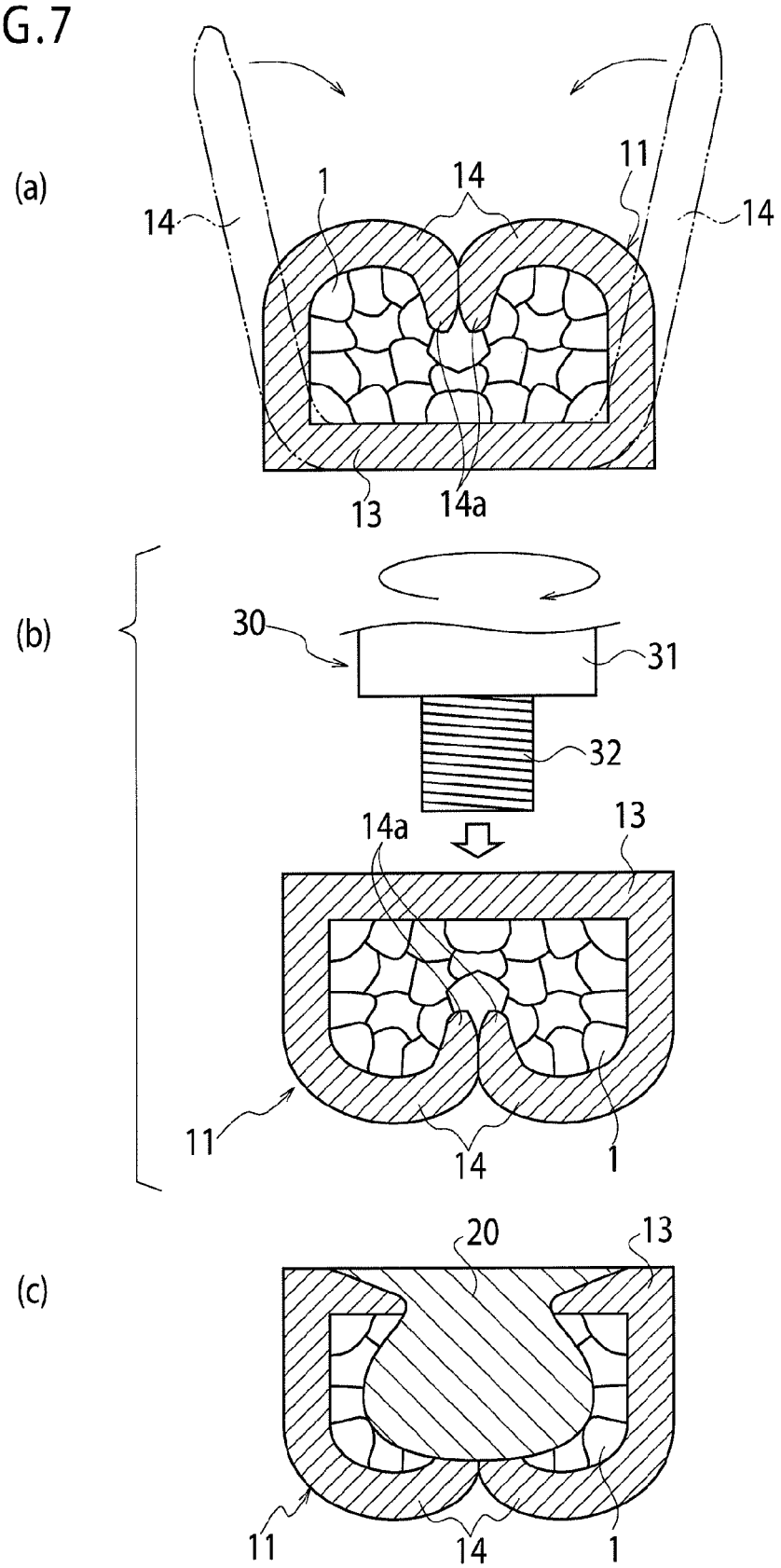
FIGS. 7(*a*), 7(*b*) and 7(*c*) are cross-sectional views showing a manufacturing procedure of the terminal connection structure according to the first embodiment.

As shown in FIG. 7(*a*), the conductor 1 with the wire W being exposed is then mounted on an upper surface of the base section 13 of the wire crimping section 11 of the terminal 10, and the pair of caulking sections 14 is caulked to cover the upper part of the conductor 1 (a wire crimping process), thereby crimping the conductor 1 in the wire crimping section 11.

Friction agitation connection is then performed by using a connection tool 30 (a friction-agitation connecting process). As shown in FIG. 7(*b*), the connection tool 30 includes a shoulder section 31, and a pin section 32 provided to protrude at the tip of the shoulder section 31 at a rotation center thereof. The connection tool 30 can rotatingly drive the shoulder section 31 and the pin section 32. The pin section 32 has such a length that plastic flow can be caused at least at tip sections 14*a* (shown in FIGS. 7(*a*) and 7(*b*)) of the pair of caulking sections 14 when the pin section 32 is dug from the bottom surface of the base section 13.

The wire crimping section 11 is placed to cause the bottom surface of the base section 13 to face the connection tool 30 having the configuration mentioned above. The shoulder section 31 and the pin section 32 are rotatingly driven to dig the rotating pin section 32 into the wire crimping section 11 from the base section 13, and then the pin section 32 is pulled out after a certain period of time. When the rotating pin section 32 is dug into the wire crimping section 11, the wire crimping section 11 and the conductor 1 at that portion are softened by frictional heat due to a friction-rotation agitating action of the pin section 32 to cause plastic flow. The wire crimping section 11 and conductor 1 in the state of plastic flow are rapidly cooled and solidified by heat conduction after the pin section 32 is pulled out, thereby forming the friction-agitation connection section 20 shown in FIG. 7(*c*). The friction-agitation connection section 20 is formed by making the conductor 1, the base section 13, and the pair of caulking sections 14 into the state of integrated plastic flow. In this way, the terminal connection structure shown in FIGS. 6(*a*) to 6(*c*) is manufactured.

As explained above, the wire crimping section 11 of the terminal 10 includes the base section 13 upon which the conductor 1 of the wire W is arranged, and a pair of caulking sections 14 that is formed in extension from the base section 13 and is caulked so as to crimp the conductor 1 from above. The friction-agitation connection section 20, which is formed by making the conductor 1, the base section 13, and the pair of caulking sections 14 into the state of integrated plastic flow, is provided on the wire crimping section 11. Accordingly, the conductor 1 and the wire crimping section 11 are fixed by the crimping force and the connection force by the friction-agitation connection section 20. Because the conductor 1 is fixed by the pair of caulking sections 14 and also fixed to the base section 13 by the friction-agitation connection section 20, the conductor 1 is rigidly fixed between the pair of caulking sections 14 and the base section 13. Therefore, no gap is generated between the conductor 1 and the pair of caulking sections 14 and also between the conductor 1 and the base section 13 because of terminal deformation due to an external force or slight terminal deformation due to a temperature change of the external environment or energization heat generation. Consequently, a decrease in the electric contact resistance and an increase in the fixing strength (tensile strength) can be ensured sufficiently and reliably.

The conductor 1 is arranged in the wire crimping section 11 without any gap. Therefore, the element wires of the conductor do not become loose due to an external force or the like, and thus an increase in the electric contact resistance and a decrease in the fixing strength (tensile strength) resulting from the loosened element wires can be prevented.

In the friction-agitation connecting process, the connection tool 30 is operated from the side of the base section 13. Because an external surface of the base section 13 is flat, workability is high.

The external connection section 12 has a round shape with the mounting hole 12*a*. However, needless to mention, other shapes can be also employed.

Second Embodiment

Figure 8:
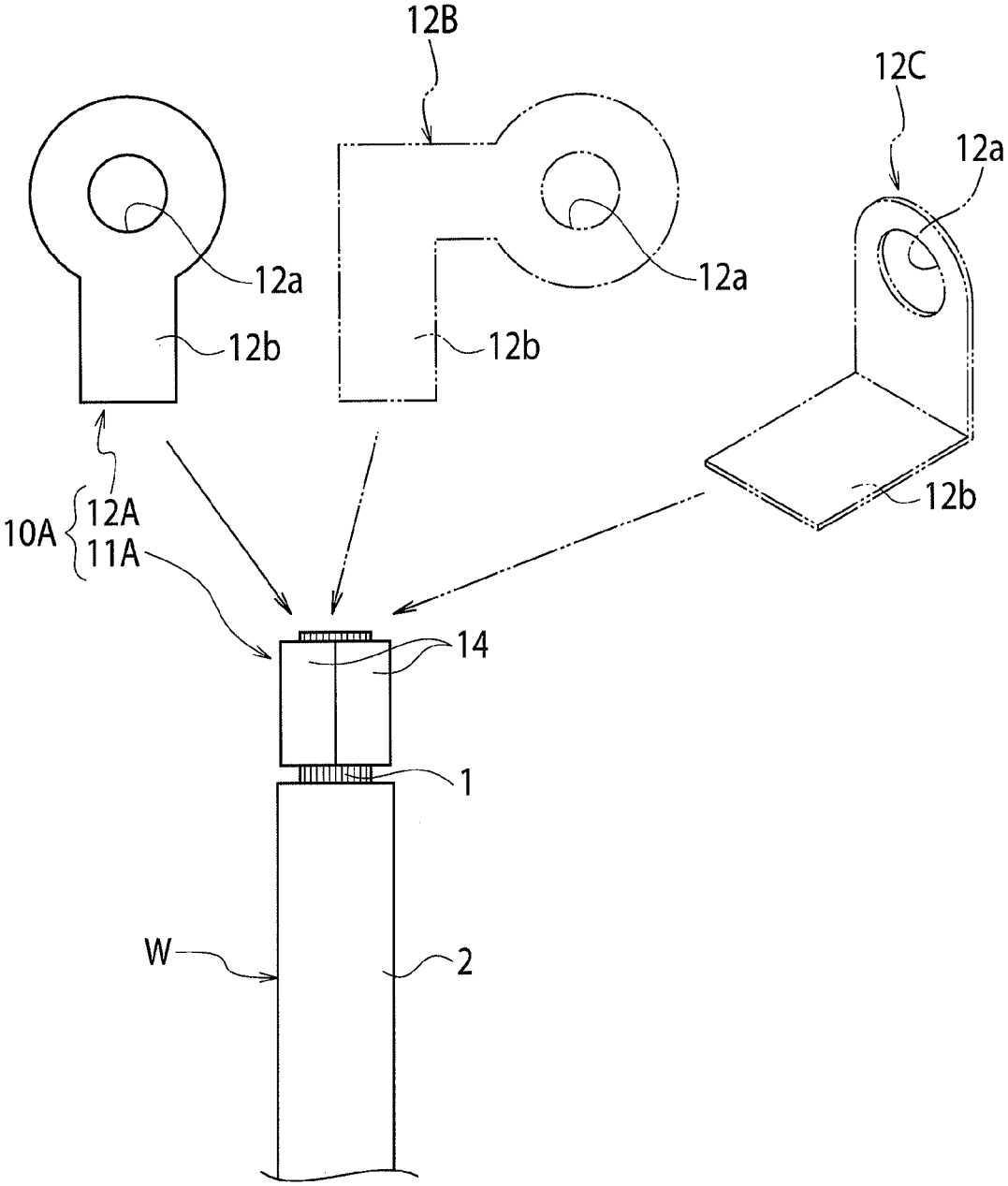
FIG. 8 shows a second embodiment of the present invention and is a top view of a terminal connection structure.

FIG. 8 shows a terminal connection structure according to a second embodiment of the present invention. When the terminal connection structure of the second embodiment is compared with that of the first embodiment in FIGS. 7(*a*) to 7(*c*), a terminal 10A includes a wire crimping section 11A and an external connection section 12A which is a separate body from the wire crimping section 11A. The external connection section 12A has a flat connecting surface section 12*b*. A friction-agitation connection section 20A is formed by making not only the base section 13, the conductor 1, and the pair of caulking sections 14 but also the connecting surface section 12*b* of the external connection section 12A into a state of integrated plastic flow. The base section 13 of the wire crimping section 11A and the external connection section 12A are fixed by a connection force of the friction-agitation connection section 20A (see FIG. 10).

Other configurations are the same as those in the first embodiment and thus explanations thereof will be omitted to avoid redundancy. Like constituent parts in the drawings are denoted by like references for clarification.

A manufacturing procedure of the terminal connection structure described above is explained next.

The insulating coating 2 at an end of the wire W is first peeled to expose the conductor 1.

The conductor 1 with the wire W being exposed is then mounted on an upper surface of the base section 13 of the wire crimping section 11A, and the pair of caulking sections 14 is caulked to cover the upper part of the conductor 1 (the wire crimping process), thereby crimping the conductor 1 in the wire crimping section 11.

Figure 9:
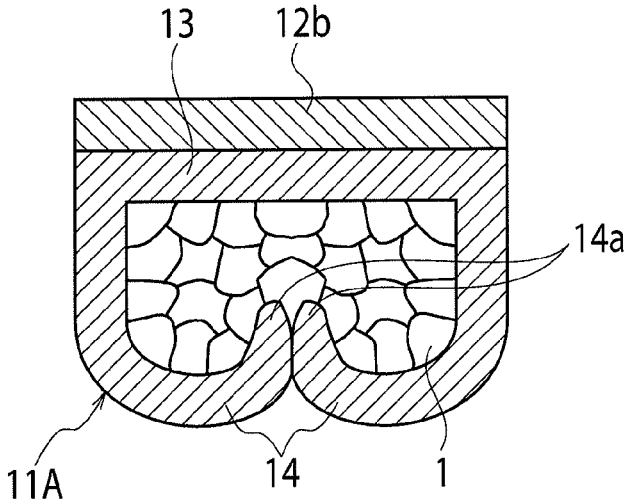
FIG. 9 shows the second embodiment and is a cross-sectional view showing a state where an external connection section is closely attached to a rear surface of a wire crimping section.

As shown in FIG. 9, the connecting surface section 12*b* of the external connection section 12A is then arranged in a closely attached state on a lower surface of the base section 13 of the wire crimping section 11.

Friction agitation connection is then performed by using a connection tool (not shown) (the friction-agitation connecting process). Because the configuration of the connection tool is the same as that in the first embodiment, explanations thereof will be omitted.

Figure 10:
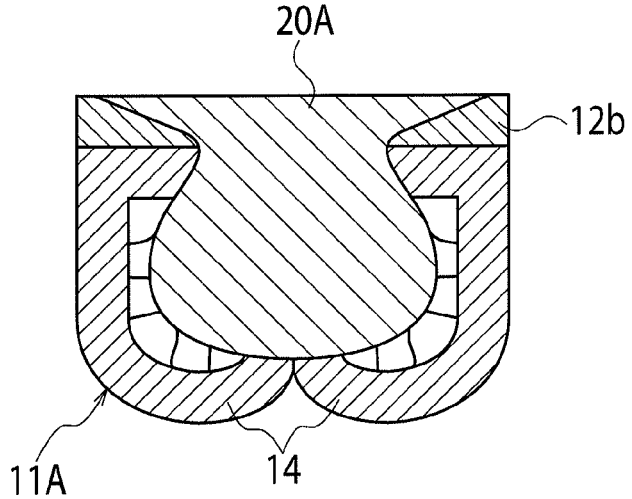
FIG. 10 shows the second embodiment and is a cross-sectional view showing a state where a friction-agitation connection section is formed.

The bottom surface side of the external connection section 12A is arranged to face the connection tool. That is, the connection tool is operated from the side of the external connection section 12A. Friction agitation connection is then performed as explained in the first embodiment to form the friction-agitation connection section 20A shown in FIG. 10. The friction-agitation connection section 20A is formed by making the conductor 1, the external connection section 12A, the base section 13, and the pair of caulking sections 14 into a state of integrated plastic flow. In this way, the terminal connection structure shown in FIG. 10 is manufactured.

As described above, the same operation and effect as those in the first embodiment are achieved also in the second embodiment.

Furthermore, the terminal 10A includes the wire crimping section 11A and the external connection section 12A which is a separate body from the wire crimping section 11A, and the friction-agitation connection section 20A is formed by making also the external connection section 12A into the state of integrated plastic flow. Accordingly, when the wire crimping section 11 and the external connection section 12 are an integrated component (in the case of the first embodiment), and when the number of forms of the wire crimping section 11 is N and the number of forms of the external connection section 12 is M, (N×M) components (terminals 10) need to be manufactured. On the other hand, in the second embodiment, it suffices to manufacture only (N+M) components, thereby enabling to reduce the number of components of the terminal 10A. For example, when the number of forms of the wire crimping section 11A (not shown) is two and the number of forms of the external connection sections 12A to 12C is three (shown in FIG. 8), terminals in the forms of all the combinations can be manufactured only by manufacturing two types of the wire crimping section 11A and three types of the external connection sections 12A to 12C, that is, 5 components in total.

In the friction-agitation connecting process, the connection tool (not shown) is operated from the side of the external connection section 12A. Because the external surface of the external connection section 12A is flat, workability is high.

Third Embodiment

In the first and second embodiments, the pin section 32 of the connection tool 30 is dug into a predetermined position of the wire crimping section 11, and is pulled out directly after the predetermined period of time, thereby forming the friction-agitation connection section 20 with spot connection. However, when the wire crimping section 11 of the terminal 10 is larger than the pin section 32 of the connection tool 30, the pin section 32 dug into the wire crimping section 11 can be moved to form the friction-agitation connection section 20 in a wide range.

The entire contents of Japanese Patent Application No. 2010-164761 (filed on Jul. 22, 2010) are incorporated by reference in the specification of the present application.

The present invention is not limited to the embodiment explained above and can be embodied in various manners by being properly modified.

The invention claimed is:

1. A terminal connection structure for connecting a terminal to a wire, comprising:

a wire crimping section of the terminal, the wire crimping section having a base section upon which a conductor of the wire is arranged, and a caulking section formed in extension from the base section and caulked so as to crimp the conductor; and a friction-agitation connection section having both of the base section and the caulking section together with the conductor solidified from a state of integrated plastic flow.

2. The terminal connection structure according to claim 1, wherein the terminal has an external connection section as a separate body from the wire crimping section; and the friction-agitation connection section is formed by making also the external connection section together with the base section, the caulking section, and the conductor into the state of integrated plastic flow.

3. A method of manufacturing a terminal connection structure, comprising:

a wire crimping step of mounting a conductor on an upper surface of a base section of a wire crimping section of a terminal, and caulking a caulking section formed in extension from the base section to cover the conductor, thereby crimping the conductor; and a friction-agitation connection-processing step of, after the wire crimping step, performing friction-agitation connection processing to the wire crimping section by using a connection tool, and making both of the base section and the caulking section together with the conductor into a state of integrated plastic flow, thereby forming a friction-agitation connection section.

4. The method of manufacturing a terminal connection structure according to claim 3, wherein the connection tool is operated from a side of the base section in the friction-agitation connection-processing step.

5. The method of manufacturing a terminal connection structure according to claim 3, wherein the terminal includes an external connection section as a separate body from the wire crimping section; and in the friction-agitation connection-processing step, the external connection section is closely attached to an external surface of the wire crimping section, the connection tool is operated from a side of the external connection section, and the external connection section is also made into the state of integrated plastic flow, thereby forming the friction-agitation connection section.

6. The method of manufacturing a terminal connection structure according to claim 4, wherein the terminal includes an external connection section as a separate body from the wire crimping section; and in the friction-agitation connection-processing step, the external connection section is closely attached to an external surface of the wire crimping section, the connection tool is operated from a side of the external connection section, and the external connection section is also made into the state of integrated plastic flow, thereby forming the friction-agitation connection section.

* * * * *